US006220686B1

(12) United States Patent
Lüdi et al.

(10) Patent No.: US 6,220,686 B1
(45) **Date of Patent: *Apr. 24, 2001**

(54) MEASUREMENT OF PAPER SPEED USING LASER SPECKLE DETECTION

(75) Inventors: Manfred Lüdi, Bern; Christian Moy, Grossaffoltern, both of (CH)

(73) Assignee: Ascom Hasler Mailing Systems AG, Bern (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/023,457

(22) Filed: Feb. 13, 1998

(51) Int. Cl.[7] ..... B41J 3/00

(52) U.S. Cl. ..... 347/4

(58) Field of Search ..... 347/4, 16, 19, 347/2, 9, 17, 101, 104, 105

(56) References Cited

U.S. PATENT DOCUMENTS

| | | | | |
|---|---|---|---|---|
| 4,074,279 | * | 2/1978 | Ikeda et al. | 347/4 |
| 4,794,384 | * | 12/1988 | Jackson | 345/66 |
| 4,875,769 | | 10/1989 | Linebarger . | |
| 4,990,791 | | 2/1991 | Nishi | 250/561 |

FOREIGN PATENT DOCUMENTS

| | | |
|---|---|---|
| 0328781 | 8/1989 | (EP) . |
| 0461437 | 12/1991 | (EP) . |
| 0718799 | 6/1996 | (EP) . |
| WO 86/06845 | 11/1986 | (WO) . |

OTHER PUBLICATIONS

"Interferometric displacement measurement on scattering surfaces utilizing speckle effect" by Leedertz, Journel of Physics E: Scientific Instruments, 3, pp 214–218 (1970).

"Measuring microvibrations by heterodyne speckle interferometry", by Dandliker and Willemin, Opt. Lett., 6, pp 165–167 (1981).

"Theory and applications of dynamic laser speckles due to in–plane object motion", by Yamaguchi and Komatsu, Opt. Acta, 24, pp 705–724 (1977).

"Velocity measurement of a diffuse object by using time–varying speckles", by Ohtsubo and Asakura, Opt. Quant. Elec., 8, pp 523–529 (1976).

"Real–time velocity measurement for a diffuse object using zero–crossings of laser speckle", by Takai, Iwai and Asakura, J. Opt. Soc. Am., 70, pp 450–455 (1980).

"Non–Contact Velocity, and Length–Measurement of Paper Using The Cross–Correlation Technique With Optical Sensors", by Ziesemer, Instrumentation and Automation in the Paper, Rubber, Plastics and Polymerization Industries, Pergamon press, pp 51–56 (1983).

(List continued on next page.)

*Primary Examiner*—John Barlow
*Assistant Examiner*—Charles W. Stewart, Jr.
(74) *Attorney, Agent, or Firm*—James F. McLaughlin; Perman & Green, LLP

(57) ABSTRACT

In a postage printing device, a printer is employed to print postage indicia on mail pieces. The printer is preferably a noncontact printer such as an ink-jet printer. Printing occurs as the mail piece moves relative to the print head of the printer, which requires that reliable motion information (e.g. a print clock signal) be made available to the electronics driving the print head. The reliable motion is provided in a noncontact way, preferably by directing a laser beam toward the mail piece and detecting a moving speckle pattern in the light scattered from the mail piece.

16 Claims, 1 Drawing Sheet

OTHER PUBLICATIONS

"Correlation in instruments: cross correlation flowmeters", by Beck, Journal Phys. E: Sci. Instrum., 14, pp 7–19 (1981).
"A Speckle Pattern Velocimeter Using a Periodical Differential Detector", by Ogiwara and Ukita, Jpn. App. Phys. Suppl., 14, pp 307–310 (1975).
"Jet Speed Measurement by Correlation of Optical Signals", by Bolon, Moisan and Sabater, Instrumentation and Automation in the Paper, Rubber, Plastics and Polymerization Industries, Pergamon press, pp 43–50 (1983).

* cited by examiner

MEASUREMENT OF PAPER SPEED USING LASER SPECKLE DETECTION

The invention relates generally to printing on mail pieces, and relates more particularly to noncontact printing on moving mail pieces, in which the motion is detected in a noncontact fashion, preferably by detecting the speckle pattern on a mail piece when illuminated by a coherent, monochromatic beam of light such as a laser.

BACKGROUND OF THE INVENTION

Many decades of experience have permitted development of highly reliable, sturdy, and inexpensive postage meters (franking machines). These include the many models of postage meter developed by the same assignee as the assignee of the present invention, such as the Smile series of meters.

Notwithstanding the high reliability, sturdiness, and inexpensiveness of such postage meters, some postal authorities have suggested that such meters be discontinued from use and that postage indicia be printed instead by means of digitally controlled printers, typically employing off-the-shelf inks and printing devices. While at first blush it might seem that such printing methods would be subject to fraud of many different types, it has been suggested that this great risk of fraud might be protected against by placing a machine-readable entity such as a high-resolution two-dimensional bar code in the digitally printed indicium. The bar code would contain information that has been cryptographically processed to permit authentication of the bar code, and thus of the legitimacy of the postal indicium.

A critical service decision of the postal authority is what to do about mail pieces that have postal indicia for which the bar code cannot be read completely enough to permit its authentication. One choice is to mark all such mail "return to sender", a choice which would be extremely undesirable if the result were the return of an appreciable number of mail pieces which were, in fact, authentic despite having bar codes that, for some reason, cannot be read in sufficient detail to permit authentication.

The other possibility is to deliver mail pieces for which the bar code is not sufficiently readable, rather than to return them to the sender. If such a policy were adopted and if it were to become generally known, then many parties would be tempted to attempt to obtain free postal services by using conventional printers to print plausible-looking postage indicia that contained bar codes with intentionally unreadable bar codes.

In the face of these concerns, it is immediately apparent to those skilled in the art that the bar code must indeed be of high resolution, with very little dimensional distortion. For the designer of a postage printer, however, this is not an easy goal to achieve. Even the slightest inaccuracy in the measured position (and velocity) of a mail piece will result in a printed indicium that is stretched, or compressed, or otherwise distorted in the dimension through which the mail piece moves during printing.

Those who are skilled in the art of postage printing will immediately appreciate that printing on mail pieces is more difficult than other printing tasks, for example because mail pieces are of varying thickness, are made of varying materials, and each piece tends to be irregular in thickness. It is, by comparison, quite easy to print on sheets of uniform thickness, dimensions, and materials. A further difficulty with printing on mail pieces is that they often move with nonuniform velocity and are introduced into the postage printer at irregular and unpredictable times.

A typical prior art way of measuring movement and position of a mail piece is by means of opposing resilient rollers in gripping contact with the mail piece; a resolver or other position transducer generates a signal indicative of movement of the mail piece. Such a measurement method has numerous drawbacks. For example, the pressured contact of the rollers with the mail piece can cause the mail piece to flex or otherwise move relative to the paper path, thus disturbing its position relative to the print head which is typically an ink-jet print head. Because an ink-jet print head requires precise positioning relative to its target (here, a mail piece), then the flexing and other movement caused by opposed rollers may disturb the printing.

Many other problems present themselves with contact-type movement sensing. For example, a mail piece of irregular thickness will give rise to inaccuracies in the measured movement, because the rollers ride up and down the irregularities of the mail piece.

For all these reasons, it is desirable to provide a reliable means of measurement of movement of a mail piece, preferably a means that does not require contact with the mail piece.

SUMMARY OF THE INVENTION

In a postage printing device according to the invention, a printer is employed to print postage indicia on mail pieces. The printer is preferably a noncontact printer such as an ink-jet printer. Printing occurs as the mail piece moves relative to the print head of the printer, which requires that reliable motion information (e.g. a print clock signal) be made available to the electronics driving the print head. The reliable motion is provided in a noncontact way, preferably by directing a laser beam toward the mail piece and detecting a moving speckle pattern in the light scattered from the mail piece. In this way, a precise measurement of mail piece movement is made which permits printing an accurate printed indicium on the mail piece.

DESCRIPTION OF THE DRAWING

The invention will be described with respect to a drawing in several figures, of which.

DETAILED DESCRIPTION

Figure 1:
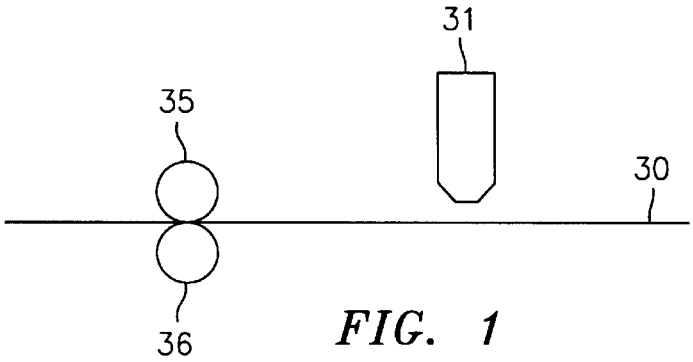
FIG. 1 shows a side view of a generalized paper path.

FIG. 1 shows a side view of a generalized paper path. A mail piece 30 moves laterally (to the right in FIG. 1) past a print head 31, typically an ink-jet print head. (Other print technologies may be employed without departing in any way from the invention.) Resilient rollers 35, 36 are positioned opposite each other relative to the paper path of the mail piece 30, and are biased toward each other. A resolver or other position transducer, omitted for clarity from FIG. 1, may be mechanically coupled with one of the rollers so as to provide an electrical signal indicative of the lateral movement of the mail piece 30.

In some prior-art printing systems the print head 31 moves perpendicularly to the movement of the target 30, that is, in and out of the page in FIG. 1. With such a printer, the usual design decision is to hold the target 30 motionless when printing is happening, and then to refrain from printing during times when the target 30 is moving laterally, for example to the right in FIG. 1. Such a system leads to jerky movement of the target 30, rather than continuous movement thereof. For lightweight individual sheets of paper this is not unacceptable and indeed many commercially successful ink-jet printers employ just such a jerky motion of paper through the printer. Because the paper is motionless at the time of printing, it is a relatively easy matter to determine when drops of ink should be fired to the paper, because it is only necessary to monitor the position of the print head as it moves across the paper, and such monitoring is not mechanically difficult. For example, a plastic tape may be held along the path of the print head, with an optosensor detecting stripes in the tape. The detected stripes are used to clock data to the firing actuators of the print head.

In some other prior-art printing systems the print head 31 is motionless and the target 30 moves relative to the print head 31 at the time that the print head 31 is printing. In such a case, a resolver or encoder is used to pick up and measure rotation of one of the rollers 35, 36, and a signal derived from the resolver or encoder is used to clock data to the firing actuators of the print head.

Figure 2:
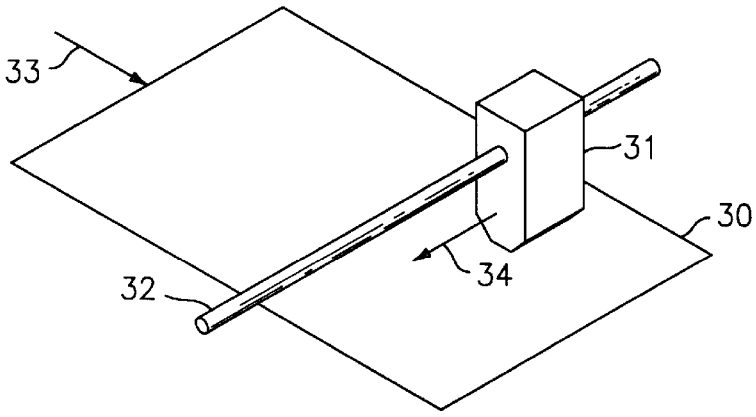
FIG. 2 shows a perspective view of a generalized paper path.

FIG. 2 shows a perspective view of a generalized paper path of a prior-art printing system of the type in which the print head moves perpendicularly to the movement of the target. The target 30 moves along its paper path as shown by arrow 33. The print head moves along a guide rail 32, for example in the direction indicated by arrow 34. The movement of the target 30 stops and starts repeatedly, to permit printing by the print head 31 during the stopped intervals.

Figure 3:
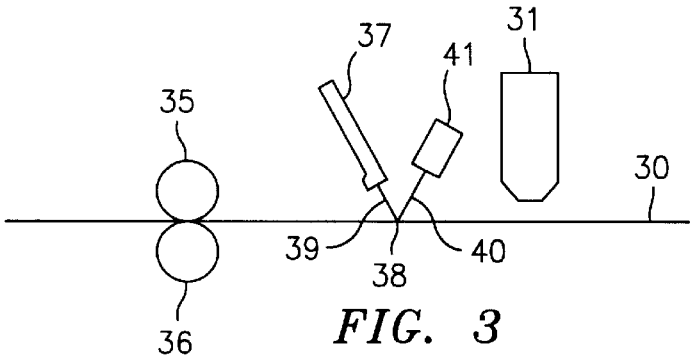
FIG. 3 shows a side view of a paper path according to one embodiment of the invention.

FIG. 3 shows a side view of a paper path according to one embodiment of the invention. In this embodiment, an ink-jet print head 31 is positioned relative to the paper path of the mail piece 30. Laser 37 is positioned relative to the paper path and directs a monochromatic, coherent beam of light 39 toward the mail piece 30. Scattered light goes in many directions and gives rise to constructive and destructive interference, sensed in direction 40 by sensor 41.

The assumption is that the mail piece has a surface that is not shiny, that is, its roughness is greater than the illuminating wavelength. In this case, the phenomenon of speckles is observed. The monochromatic laser light is diffusely reflected in all directions in a random way. This diffuse reflection causes phase shifts in the reflected light that are highly dependent on the surface structure; the result is a surface phenomenon.

Figure 4:
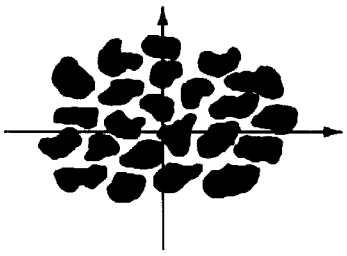
FIG. 4 shows a typical speckle pattern as seen at a detector.

When an imaging device is used, it is seen that there are regions of constructive and destructive interference formed on the device. When a retina of a human eye is employed as the imaging device, the regions of constructive and destructive interference are perceived as a pattern of speckles. It is also noted that the speckle pattern moves if the reflection surface (here, a mail piece) moves. Movement of the speckle pattern is directly correlated with movement of the mail piece. FIG. 4 shows a typical speckle pattern as seen at a detector.

In the system according to the invention, the speckle detection may be in a single photodetector, such as a photodiode or a phototransistor, or in any arbitrary array thereof. The photodetector used is not limited to a specific shape or size. CCD-type sensors of any shape may also be employed. With any of these detectors, a signal may be derived that is indicative of motion of the mail piece, and may be used to clock data to the firing actuators of the print head 31.

Another detection approach is simply to sense the light intensity at a detection point. As regions of constructive and destructive interference pass by the point, and the detected signal is a fast sequence of bright and dark events. This sequence may be evaluated as a frequency. A calibration may be performed that is a function of the geometrical setup of the apparatus and of the wavelength of light employed.

The laser 37 is preferably a laser diode. The laser diode may emit visible or infrared light, as desired.

While the invention has been described with respect to particular embodiments, it is not limited thereto. For example, the light source is shown as a laser but the benefits of the invention present themselves with any source of a monochromatic, coherent light beam. Those skilled in the art will have no difficulty appreciating that there are numerous obvious variations which nonetheless fall within the scope of the invention, as defined by the claims that follow.

We claim:

1. A method of printing on a mail piece with a postage printing device, comprising the steps of directing a laser beam from a laser of the postage printing device toward the mail piece wherein light is scattered therefrom, said scattered light defining a speckle pattern, detecting motion of the speckle pattern by a detector, and printing by a printer of the postage printing device upon the mail piece based, at least partially, upon said motion detected by said detector.

2. The method of claim 1 wherein the printer is a noncontact printer.

3. The method of claim 1 wherein the printer is an ink-jet printer.

4. The method of claim 1 wherein the printer remains fixed in position relative to the laser and the detector, wherein the mail piece moves relative to the laser, the detector, and the printer, and wherein the printing is performed relative to a clock signal, said clock signal changing depending upon the detected motion.

5. The method of claim 1 wherein the laser emits visible light.

6. The method of claim 5 wherein the laser emits red light.

7. The method of claim 1 wherein the laser is infrared.

8. Apparatus for printing on a mail piece, said mail piece movable within said apparatus, said mail piece motion defining a paper path, said apparatus comprising a laser position relative to the paper path and directed theretoward, a detector positioned relative to the paper path to detect laser light scattered from the mail piece, said scattered light defining a speckle pattern, and a printer positioned relative to the paper path for printing on the mail piece, said printer being adapted to print postage indicia on the mail piece, said detector disposed to detect apparent motion in the speckle pattern, said printer operatively coupled with said detector to print the postage indicia on the mail piece based, at least partially, on said detected apparent motion, wherein said printed postage indicia can be printed with a high resolution and reduced dimensional distortion for a variety of velocities of the mail piece.

9. The apparatus of claim 8 wherein the printer is a noncontact printer.

10. The apparatus of claim 8 wherein the printer is an ink-jet printer.

11. The apparatus of claim 8 wherein the printer remains fixed in position relative to the laser and the detector, wherein the mail piece moves relative to the laser, the detector, and the printer, and wherein the printing is performed relative to a clock, said clock depending upon said detected apparent motion.

12. The apparatus of claim 8 wherein the laser emits visible light.

13. The apparatus of claim 12 wherein the laser emits red light.

14. The apparatus of claim 8 wherein the laser is infrared.

15. A method of printing a postage indicia on a mail piece, the method comprising steps of:

detecting motion of the mail piece comprising directing light at the mail piece, allowing the light to form a speckle pattern, and detecting movement of the speckle pattern; and controlling printing of a postage indicia printer, based at least partially upon the detected motion of the mail piece, to print the postage indicia on the mail piece.

16. A method as in claim 15 wherein the step of detecting detects velocity of the mail piece and the step of controlling increases or decreases printing speed dependent upon the detected mail piece velocity.

* * * * *